US006862812B2

(12) United States Patent
Mühlebach

(10) Patent No.: US 6,862,812 B2
(45) Date of Patent: Mar. 8, 2005

(54) CUTTING DEVICE

(76) Inventor: Moritz Mühlebach, Schwerzelbodenstrasse 42, 8305 Dietlikon (CH)

( * ) Notice: Subject to any disclaimer, the term of this patent is extended or adjusted under 35 U.S.C. 154(b) by 74 days.

(21) Appl. No.: 10/606,241

(22) Filed: Jun. 26, 2003

(65) Prior Publication Data

US 2004/0035006 A1 Feb. 26, 2004

Related U.S. Application Data

(63) Continuation-in-part of application No. 09/964,873, filed on Sep. 28, 2001, now abandoned.

(51) Int. Cl.[7] ..... B26B 29/00

(52) U.S. Cl. ..... 30/293; 30/294; 30/319; 30/320; 83/614

(58) Field of Search ..... 30/293, 294, 319, 30/2, 320, 314, 347, 377, 276; 83/614, 881, 886, 631

(56) References Cited

U.S. PATENT DOCUMENTS 124,114 A 2/1872 Bright
2,567,102 A * 9/1951 Cook ..... 30/294
3,726,010 A 4/1973 Yokoyama
3,991,467 A 11/1976 Yokoyama
4,001,936 A 1/1977 Matsuhita
4,064,626 A 12/1977 Meshulam et al.
4,148,142 A 4/1979 Sullivan et al.
4,354,314 A * 10/1982 Pierce ..... 30/293
5,203,086 A * 4/1993 Dann ..... 30/293
5,272,947 A 12/1993 Peters
5,815,929 A 10/1998 Ojea
5,881,463 A 3/1999 Casteel et al.
6,112,417 A 9/2000 Hyer et al.

* cited by examiner

*Primary Examiner*—Timothy V. Eloy
*Assistant Examiner*—Phong Nguyen
(74) *Attorney, Agent, or Firm*—Dykema Gossett PLLC

(57) ABSTRACT

A cutting device (1) for floor coverings, intended for cutting or starting a tear of seams, includes a base body (2) with at least one blade (3) that is mounted on the base body (2), and a contact edge (4), formed on the bottom side (5) of the base body (2), for an edge of a floor covering. A set of distance plates (6 to 10) are attached in the front area of the base body (2), and the blade (3) can be arranged parallel to the contact edge (4) and between two of the plates, which are of different thickness, so that a change of the arrangement of the plates allows the simple adjustment of the cutting width.

8 Claims, 3 Drawing Sheets

CUTTING DEVICE

CROSS-REFERENCE TO RELATED APPLICATION

This application is a continuation-in-part of application Ser. No. 09/964,873, filed Sep. 28, 2001 now abandoned, the priority of which is hereby claimed.

BACKGROUND OF THE INVENTION

1. Field of the Invention

The invention relates to a cutting device for floor coverings, intended for cutting or starting a tear of seams, including a base body and at least one blade that is held to the base body, and with a contact edge on the bottom side of the base body for an edge of a floor covering. In the front part of the base body a removable first plate and a removable second plate are attached to the base body, and the blade can be arranged parallel in relation to the contact edge between the plates.

2. The Prior Art

A cutting device of the above-noted type is already known from practical applications. The cutting device that is known includes exactly two plates that have a blade arranged between them. Arranging the blade between the first plate and the base body in order to cut or start a tear of a seam is not possible because the first plate follows immediately after the contact edge. Even though the known cutting device has a blade arranged between the first plate and the base body, this is only a back-up blade, which is only stored between the first plate and the base body and does not extend beyond the base body. Therefore, any cutting action with the substitute blade is not possible. It is disadvantageous that, due to the selected two-plate arrangement, the cutting width of the known cutting device cannot be adjusted, i.e., the distance between the contact edge and the blade cannot be adjusted.

Therefore, it is the object of the present invention to provide a cutting device of the noted kind that will allow for simple cutting width adjustments.

SUMMARY OF THE INVENTION

According to the invention this objective is achieved principally by including at least one additional plate, allowing the blade, if necessary, to be arranged between the second and the additional plate or between adjacent additional plates. The realization according to the invention allows for simple cutting width adjustments because the blade is now arranged not only between the first plate and the second plate, but it can optionally also be arranged between the second plate and the additional plate or between additional adjacent plates. In known cutting devices the plates only fulfill a holding or clamping function. But the invention provides that, in addition to the holding function, the plates also serve as spacer blocks in order to modify the cutting width, which is the distance between the blade and the contact edge.

In order to be able to adjust to different cutting widths, at least one plate has a different width than another plate. Utilizing different width dimensions for individual or for all plates makes adjustments to different cutting widths possible.

A clamping device is used for mounting and fastening the removable plates to the base body. In a preferred embodiment, a clamping device is a screwed connection comprised of screw and nut, with the screw being inserted through the wall and the plates.

The cutting device of the kind referred to above also corresponds to a cutting device that was outlined previously and which is known from practical applications, providing for the blade to be held on the base body between the first plate and the second plate. The blade is mounted by way of a clamped joint. The clamped joint is also used for clamping the plates in place. For this purpose, the blade is positioned on the attachment screw and can be swung out by its cutting edge from between the two plates, if necessary, thereby causing the cutting edge to extend beyond the bottom edge of the base body, depending on the desired cutting depth.

A disadvantageous aspect of the cutting device that is known in the art is that the front end of the blade is set back in relation to the leading edge or the front end of the base body, which is why complete cutting of the seam up to the limit stop is not possible anyway. But it is also important to note that wall-to-wall cutting is also not possible since there is a considerable gap between the back end of the blade and the back end of the base body. To allow for wall-to-wall cutting action with the realization that is known in the art, two blades would have to be envisioned, in particular, one blade in the area of the front end side and one blade in the area of the back end side of the base body. This realization is known from cutting devices in practical applications that are realized as a type of seesaw.

Therefore, it is an object is achieved, in principle, by providing that the blade also extends beyond the front end side of the base body and that the cutting edge or another cutting edge extends to the front end side as well. The advantages afforded by the realization according to the invention are twofold. On the one hand, using the blade extending of the front end side, it is possible to cut a covering up to a cross edge. By envisioning this cutting edge or another cutting edge on the front end side it is possible to swing the base body to such a degree that the front end side becomes arranged on the bottom side, resulting in the fact that the covering can now be cut up to its other cross edge, i.e., ultimately wall-to-wall, in particular by using single blade and performing a single cut.

To ensure proper handling during the swinging action of the knife as well, it is envisioned according to the invention that the contact edge also extends along the front end side of the base body. Thus, the contact edge is envisioned on the front end side and on the bottom side, and it is able to exercise its guiding function in both conditions.

Moreover, it is particularly advantageous that the bottom side cutting depth and the front side cutting depth are at least essentially equal. Utilizing a corresponding blade position, with the blade ultimately extending equally beyond the base body on the bottom side as well as on the front end side, it is possible to always achieve the same cutting depth, irrespective of how the base body is held.

To be able to move the base body toward a wall using its front end side or its bottom side, both sides are arranged, at least in some areas, at a right angle in relation to each other.

Even though, as a rule, it is possible for the blade to have multiple corners and multiple cutting edges, it is most convenient if the blades has at least one arc shaped cutting edge that extends from the bottom side to the front end side. In this instance, the blade is preferably realized as disc-shaped, featuring a cutting edge that runs the entire circumference of the blade.

As referred to previously, to adjust the cutting depth of the blade of the cutting device that is known from practical applications, the attachment screw is first loosened, then the blade is manually adjusted to the desired cutting depth.

During the adjustment process the blade must be touched by hand, which constitutes a high injury risk due to cuts.

Therefore, an object of the present invention consists also in providing a cutting device of the kind referred to above that will prevent injuries from occurring during the adjustment process of the cutting depth.

In essence, according to the invention this object is achieved by utilizing an adjustment device that is comprised of at least one adjusting bolt for adjusting the cutting depth of the blade. Thus, contrary to the state of the art, the present invention proposes a special adjustment device which holds the blade for adjusting the cutting depth. To provide ease of operation, it is advantageous if the adjustment device can be operated from the top side of the base body.

Preferably, the adjusting device is comprised of a screw bolt that runs through the base body, and of a further bolt that runs in a transversal direction in relation to the former and on which the blade is positioned. As part of the adjusting device the further bolt is movable, thereby allowing blade adjustments.

It is also useful if the blade is mounted on the further bolt without the ability to rotate. This results in a good cutting effectiveness of the blade, in particular, even if the clamping device is not tightened very much. If the cutting edge of the blade located on the outside has become dull, the blade is detached and, in particular applicable for disc-shaped realizations of the blade, it is rotated until another sharp cutting edge has been moved to the outside.

The individual plates feature a guide slot for the further bolt, thereby making possible the adjusting movement of the further bolt including the blade mounted thereon, inside the base body. The further bolt can be moved along this slot in order to adjust the cutting depth.

To be able to adjust the cutting depth not only on the bottom side, but simultaneously, also on the front end side, the screw bolt of the adjusting device runs at a transverse angle through the base body. The transverse arrangement of the screw bolt which is movable inside the base body, ensures the simultaneous bottom side and front side adjustment of the cutting depth of the blade.

A control means is provided to operate in conjunction with the adjusting device for adjusting the cutting depth. The control means can consist of, for example, a linearly movable adjusting slide or a locking screw.

Additional characteristics can be understood from the subsequent description of embodiments taken with the accompanying drawings.

DETAILED DESCRIPTION OF THE PREFERRED EMBODIMENTS

Figure 1:
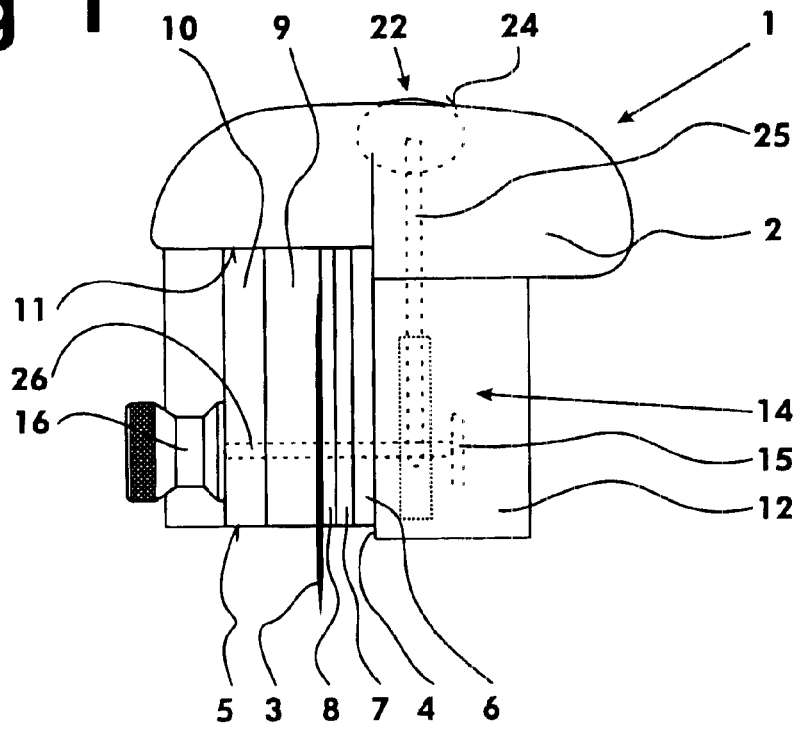
FIG. 1 shows a schematic end view of the cutting device according to the invention, showing some of its internal features.
Figure 3:
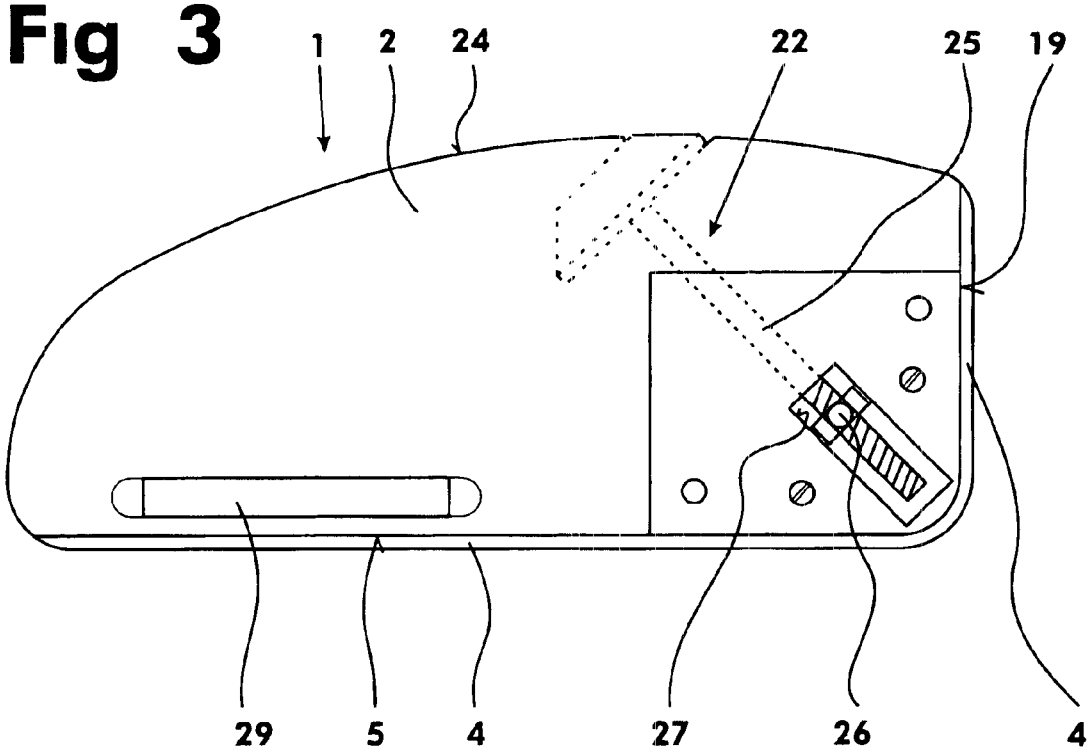
FIG. 3 shows a schematic side view of the cutting device according to the invention, also showing some of its internal features, without the distance plates.

The figures depict a cutting device 1 that cuts or starts tears of seams and can be used on floor coverings such as CV (Cushel Vinol), linoleum, needled felt, carpet felt, PVC, and rubber or cork. The cutting device 1 includes base body 2, a blade 3 and a contact edge 4. As best seen in FIGS. 1 and 3, the base body 2 includes lateral body portions 2*a* and 2*b*. The body portion 2*a* defines a generally flat front surface 19*a* and generally flat bottom surface 5*a*. The body portion 2*b* defines a generally flat front surface 19*b* and a generally flat bottom surface 5*b*. The front surface 19*b* is recessed relative to front surface 19*a* and the bottom surface 5*b* is recessed relative to bottom surface 5*a* to provide contact surfaces 4*a* and 4*b* for flooring material abutment. The blade 3 is mounted in a recess 11 formed in the lateral body portion 2*b*, as are a removable first plate 6, a removable second plate 7, and at least one additional plate 8, 9, 10 to enable the blade 3 to be located between the second plate 7 and the additional plate 8 or between adjacent additional plates 8, 9, 10. The embodiment that is described here includes three other plates 8, 9, 10 in addition to the first two plates 6, 7. Using the individual plates 6, 7, 8, 9 10, different cutting widths can easily be achieved, in particular since individual plates have different thicknesses. Plate 8 has the approximate thickness of plate 7. Naturally, it is possible to select other thickness dimensions for the individual plates as well. In terms of their arrangement in relation to each other, the plates are combined, if necessary, for the respectively wanted cutting widths.

The recess 11 is accessible from the front end, side and bottom surface at the lateral body portion 2*b* for positioning of the individual plates 6, 7, 8, 9, 10. In the embodiment shown the recess 11 is open on its side, featuring only a lateral enclosure, which is constituted by wall 12 of the body portion 2*a*.

Furthermore, a clamping device 14 is utilized for fastening the removable plates 6, 7, 8, 9, 10 on the base body 2. In the present embodiment the clamping device 14 is realized as a screwed connection, consisting of a screw 15 and a clamping nut 16.

Figure 2:
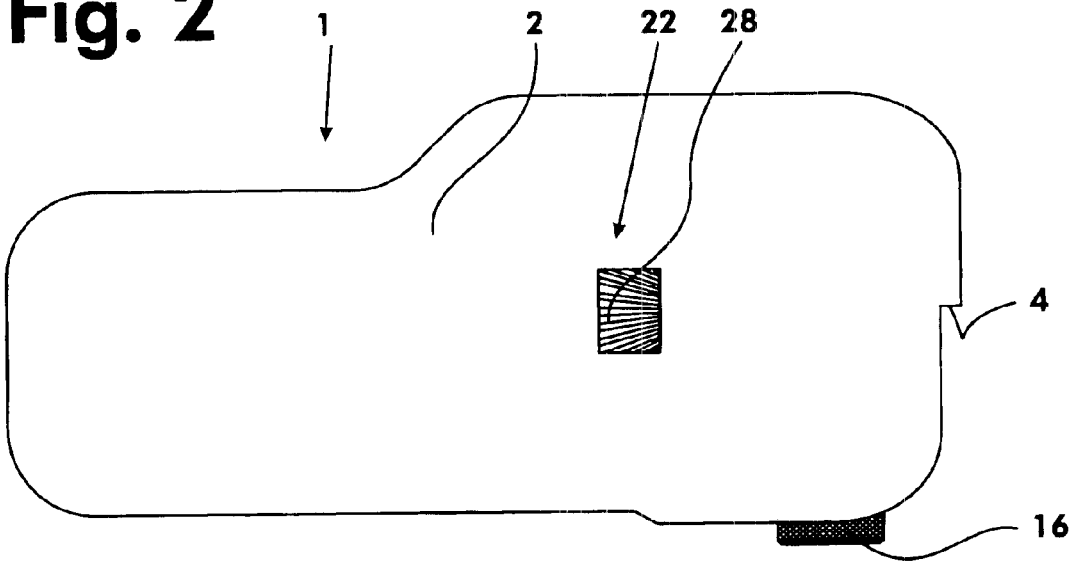
FIG. 2. shows a top view of the cutting device.
Figure 4:
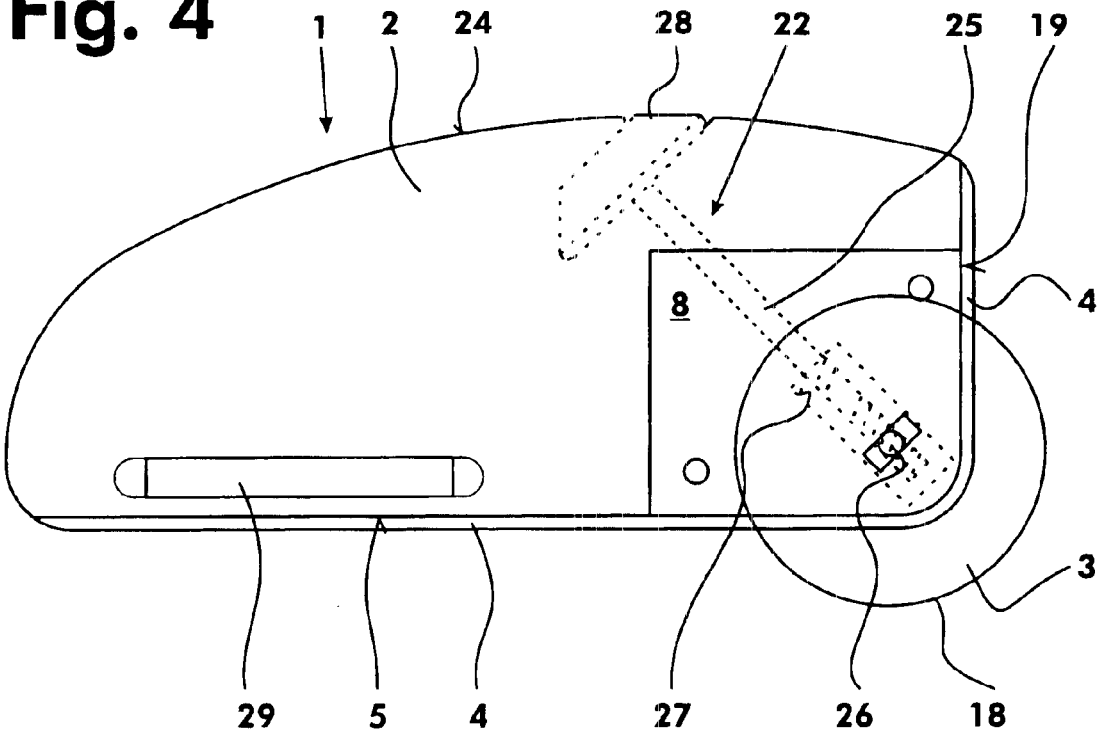
FIG. 4 shows the same side view as FIG. 3, with the blade lying on the distance plate 8.
Figure 5:
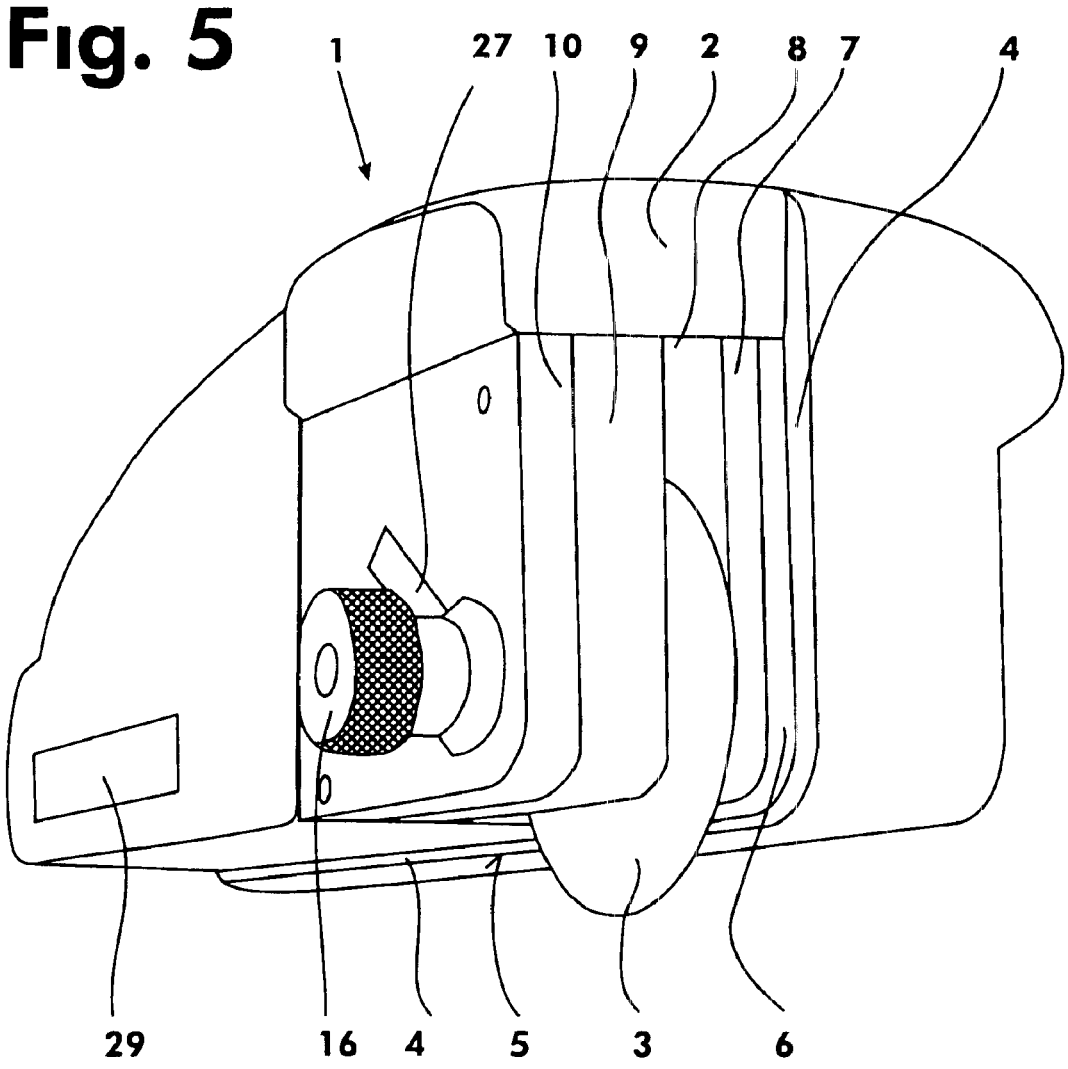
FIG. 5 shows a perspective view of the cutting device according to the invention.

As seen in particular in FIG. 4, the blade 3 extends with its cutting edge 18 beyond the bottom surface 5*b* of the lateral body portion 2*b*. It is important in this context that the blade 3 also extends beyond the front end 19*b* of the lateral body portion 2*b*, and that the cutting edge 18 extends to the front end side as well, thereby allowing cutting action on the front end 19*b*. All that is necessary for accomplishing this is that the cutting device be rotated by approximately 90° in relation to the condition depicted in FIG. 2. In order to be able to maintain the desired cutting width in this situation, the contact edge 4*b* extends from the bottom surface 5*b* along the front end side 19*b* of the base body 2. Moreover, the bottom side 5*b* and the front end side 19*b* of the base body 2 are also arranged at a right angle in relation to each other following a rounded transition in the area of the apex.

As further seen in FIG. 4, the blade 3 is disc-shaped or circular, exhibiting a cutting edge 18 running around its circumference. Principally, however, it would also be possible to provide a blade that is not realized as circular, but that has an arc-shaped cutting edge in the area that is outside of the base body 2.

Also important in the context of the present invention is an adjustment device 22 for adjusting the cutting depth of the blade 3. The adjustment device 22 can be operated from the top side 24 of the base body 2 and is equipped with a screw bolt 25, running through the lateral body portion 2*a*, as well as a further bolt 26, running at a transverse angle in relation to the former. The blade 3 is positioned on the further bolt 26.

The blade 3 is mounted to the further bolt 26 without the ability to rotate. For adjusting the cutting depth of the blade, that means for moving the further bolt 26, the clamping device 14 must be loosened. The individual plates 6, 7, 8, 9, 10 each are provided with a guide slot 27 that is open toward the side with the clamping screw 16 and the further bolt 26 is movable inside the slots. As seen in particular in FIG. 3, the screw bolt 25, runs diagonally through the base body 2. Correspondingly, the guide slot 27 is diagonally slanted.

Furthermore, the adjustment device 22 is equipped with a control means 28 that is accessible from the top side 24, acting in conjunction with the screw bolt 25 to adjust the cutting depth. The control means 28 can consists of a linearly movable adjusting slide whose upper outside surface is contoured to improve the grip.

The base body 2 is provided with a compartment 29 for a reserve blade.

I claim:

1. A cutting device which comprises:

a base body which defines first and second lateral body portions, said first and second lateral body portions respectively defining generally flat front ends and generally flat bottom surfaces, said front end and said bottom surface of said second body portion being recessed into said base body relative to said respective front and bottom surface of said first lateral body portion to provide front and bottom contact surfaces on said first body portion again which a flooring material can be butted, said second body portion defining a recess that opens to said front end and bottom surface thereof, and said base body including mounting means which extends from said first body portion into said recess, a plurality of replaceable spacer plates mounted in said recess, and a cutting blade mounted on said mounting means and between two adjacent spacer plates in said recess, said cutting blade being movable by said mounting means between a first position completely positioned within outer peripheries of said adjacent spacer plates and a second position positioned forwardly of said front end of said first body portion and below said bottom surface of said first body portion to cut flooring material as said bottom surface of said first body portion of said cutting device is moved along said flooring material.

2. A cutting device according to claim 1, wherein said spacer plates define front and bottom edges that together define the front end and bottom surface of said second body portion.

3. A cutting device according to claim 2, wherein said plurality of spacer plates include respective slots which extend diagonally toward an intersection where said front end and bottom surface of said second body portion meet, and wherein said mounting means is movable along said slots to move said cutting blade between said first and second positions.

4. A cutting device according to claim 3, wherein said mounting means comprises a first bolt which extends from said first lateral body portion to a threaded end, and including a nut which threadingly engages said threaded end of said first bolt to lock and unlock said mounting means relative to said spacer plates.

5. A cutting device according to claim 4, wherein said first lateral body portion defines a diagonal channel therein and a lateral slot which communicates said diagonal channel with said diagonal slots in said plurality of spacer plates, and wherein said mounting means includes a second bolt which extends in said diagonal channel and to which said first bolt is attached, said second bolt being rotatable so as to move said first bolt along said respective diagonal slots in said first lateral body portion and said plurality of spacer plates.

6. A cutting device according to claim 5, wherein said base body defines a top surface, wherein said top surface define an opening, and wherein said mounting means includes a dial attached to an upper end of said second bolt which is rotatable through said opening.

7. A cutting device according to claim 1, wherein said cutting blade has a disc shape.

8. A cutting device according to claim 1, wherein at least two of said plurality of replaceable spacer plates have different thicknesses.

* * * * *